US010305229B2

(12) United States Patent
Zhao

(10) Patent No.: US 10,305,229 B2
(45) Date of Patent: May 28, 2019

(54) ELECTRICAL CONNECTOR HAVING GROUND AND POWER CONTACTS EACH WITH PLURAL TAIL PORTIONS

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/032,010

(22) Filed: Jul. 10, 2018

(65) Prior Publication Data

US 2019/0013627 A1 Jan. 10, 2019

(30) Foreign Application Priority Data

Jul. 10, 2017 (CN) ..... 2017 2 0830803 U

(51) Int. Cl.

| | |
|---|---|
| ***H01R 13/648*** | (2006.01) |
| ***H01R 13/6597*** | (2011.01) |
| ***H01R 13/6471*** | (2011.01) |
| ***H01R 43/24*** | (2006.01) |
| ***H01R 13/504*** | (2006.01) |
| ***H01R 13/6594*** | (2011.01) |
| *H01R 24/60* | (2011.01) |

(52) U.S. Cl.

CPC ..... *H01R 13/6597* (2013.01); *H01R 13/504* (2013.01); *H01R 13/6471* (2013.01); *H01R 13/6594* (2013.01); *H01R 43/24* (2013.01); *H01R 24/60* (2013.01)

(58) Field of Classification Search

CPC ..... H01R 13/6597; H01R 13/6594; H01R 43/24; H01R 13/6471; H01R 13/504; H01R 13/6477; H01R 13/658; H01R 13/6581; H01R 12/721

USPC ..... 439/607.01

See application file for complete search history.

(56) References Cited

U.S. PATENT DOCUMENTS 7,699,663 B1 * 4/2010 Little ..... H01R 13/6471 439/660
7,841,905 B2 * 11/2010 Zheng ..... H01R 13/658 439/660
8,052,431 B1 * 11/2011 He ..... H01R 12/721 439/78
8,376,785 B2 2/2013 Lapidot et al.

(Continued)

FOREIGN PATENT DOCUMENTS

CN 203813082 U 9/2014

*Primary Examiner* — Jean D Duverne

(74) *Attorney, Agent, or Firm* — Wei Te Chung; Ming Chieh Chang

(57) ABSTRACT

An electrical connector includes: an insulative housing having a base and a tongue; two rows of contacts arranged in the insulative housing and exposed respectively to two opposite surfaces of the tongue, each row of contacts including an outermost ground contact and an adjacent power contact next to the ground contact; and a shielding shell enclosing the insulative housing, wherein each of the ground contact and the power contact in at least one of the two rows has a contacting portion, plural tail portions, and an intermediate portion between the contacting portion and the plural tail portions.

5 Claims, 9 Drawing Sheets

(56) References Cited

U.S. PATENT DOCUMENTS

| | | | | |
|---|---|---|---|---|
| 2005/0059296 | A1* | 3/2005 | Wang | H01R 13/6477 439/541.5 |
| 2009/0042450 | A1* | 2/2009 | Zheng | H01R 13/658 439/660 |
| 2011/0021088 | A1* | 1/2011 | Chen | H01R 13/6581 439/732 |
| 2016/0099526 | A1 | 4/2016 | Chen | |
| 2016/0211593 | A1* | 7/2016 | Tsai | H01R 25/006 |
| 2017/0018883 | A1 | 1/2017 | Chen et al. | |
| 2017/0373442 | A1* | 12/2017 | Qiu | H01R 13/6581 |

* cited by examiner

| A1 | A2 | A3 | A4 | A5 | A6 | A7 | A8 | A9 | A10 | A11 | A12 |
|---|---|---|---|---|---|---|---|---|---|---|---|
| GND | | | Vbus | | D+ | D− | | Vbus | | | GND |
| | | | | | | | | | | | |
| GND | | | Vbus | | D− | D+ | | Vbus | | | GND |
| B12 | B11 | B10 | B9 | B8 | B7 | B6 | B5 | B4 | B3 | B2 | B1 |

FIG. 9

ELECTRICAL CONNECTOR HAVING GROUND AND POWER CONTACTS EACH WITH PLURAL TAIL PORTIONS

BACKGROUND OF THE INVENTION

1. Field of the Invention

The present invention relates to an electrical connector having two rows of contacts including wide ground and power contacts to conduct large current, wherein each of the ground contact and the power contact has plural tail portions for current flow and heat dissipation consideration.

2. Description of Related Arts

U.S. Patent Application Publication No. 2017/0018883 discloses a dual orientation connector, e.g., a Universal Serial Bus (USB) Type-C connector, where a rightmost or leftmost ground terminal (Gnd) or a first supplemental terminal (SUB1) can be omitted. Furthermore, the ground terminal (Gnd) may be replaced by a power terminal (Power/VBUS) where a width of the power terminal (Power/VBUS) may be equal to a width of a first signal contact, or greater than the width of the first signal contact for large current transmission.

U.S. Pat. No. 8,376,785 describes a conventional USB3.0 connector having a first group of terminals and a second group of terminals where a ground terminal in the first group is depicted to have two tail portions.

SUMMARY OF THE INVENTION

An electrical connector comprises: an insulative housing having a base and a tongue; two rows of contacts arranged in the insulative housing and exposed respectively to two opposite surfaces of the tongue, each row of contacts including an outermost ground contact and an adjacent power contact next to the ground contact; and a shielding shell enclosing the insulative housing, wherein each of the ground contact and the power contact in at least one of the two rows has a contacting portion, plural tail portions, and an intermediate portion between the contacting portion and the plural tail portions.

BRIEF DESCRIPTION OF THE DRAWING

FIG. 9 is a schematic table showing contact arrangement of the electrical connector.

DETAILED DESCRIPTION OF THE PREFERRED EMBODIMENT

Figure 1:
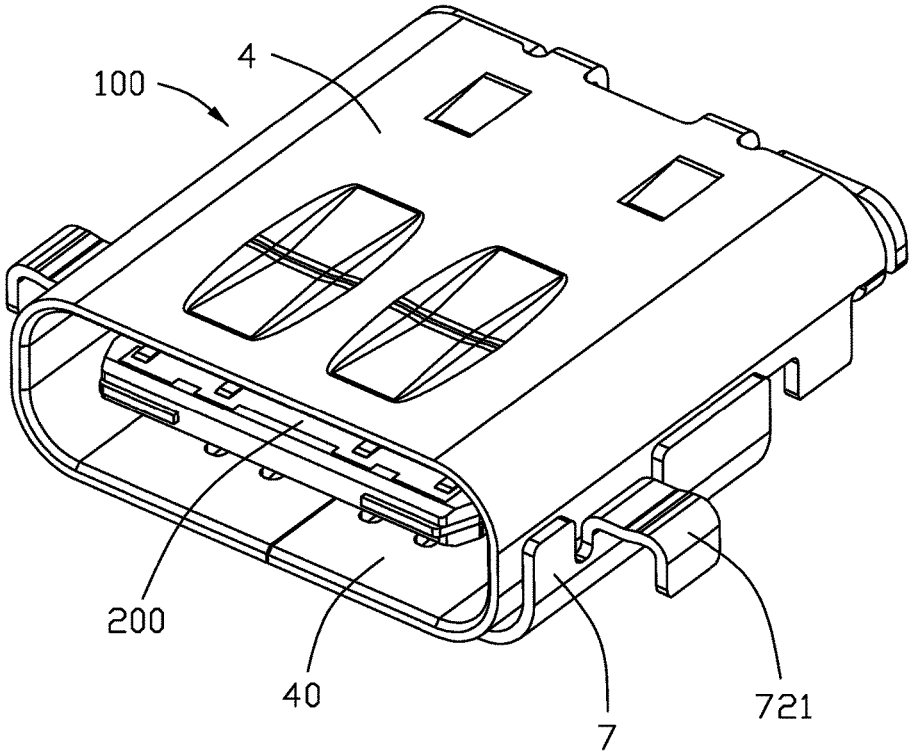
FIG. 1 is a front perspective view of an electrical connector in accordance with the present invention.
Figure 2:
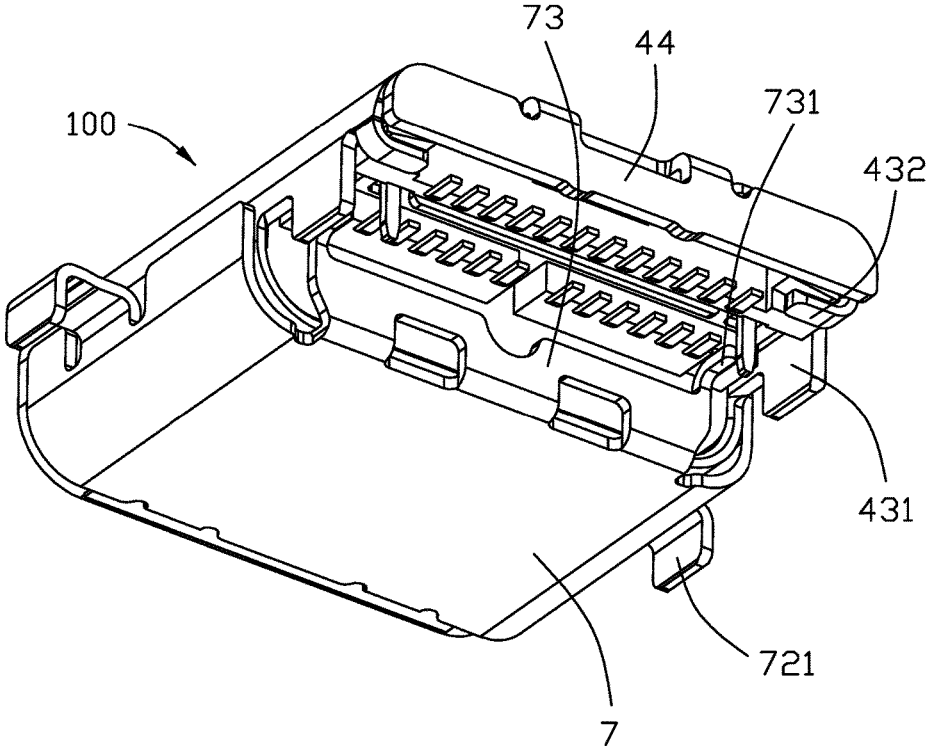
FIG. 2 is a rear perspective view of the electrical connector.

Referring to FIGS. 1-9, an electrical connector 100 comprises a contact module 200 and a shielding shell 4 enclosing the contact module 200. The electrical connector 100 may further comprise a rear sealing element 5, a water-proof film 6, and an auxiliary shell 7.

Referring specifically to FIGS. 3-9, the contact module 200 includes an insulative housing 1, two rows of contacts 2 arranged in the insulative housing 1, and a shielding plate 3 arranged in the insulative housing 1 between the two rows of contacts 2.

The insulative housing 1 includes a base 11 and a tongue 12. The insulative housing 1 is constructed of an upper insulator 13 that is insert molded with an upper row of contacts 21, a lower insulator 14 that is insert molded with a lower row of contacts 22, and an over-mold 15. The upper insulator 13 has a base part 131 and a tongue part 132. The base part 131 has a pair of recesses 1311, a pair of latches 1312, and a pair of engaging faces 1313. The lower insulator 14 has a base part 141 and a tongue part 142. The base part 141 has a pair of hooks 1411 and a pair of grooves 1412. The over-mold 15 a base part 151 and a tongue part 152. The base parts 131, 141, 151 constitutes the base 11 of the insulative housing 1. The tongue parts 132, 142, 152 constitute the tongue 12 of the insulative housing 1.

Figure 7:
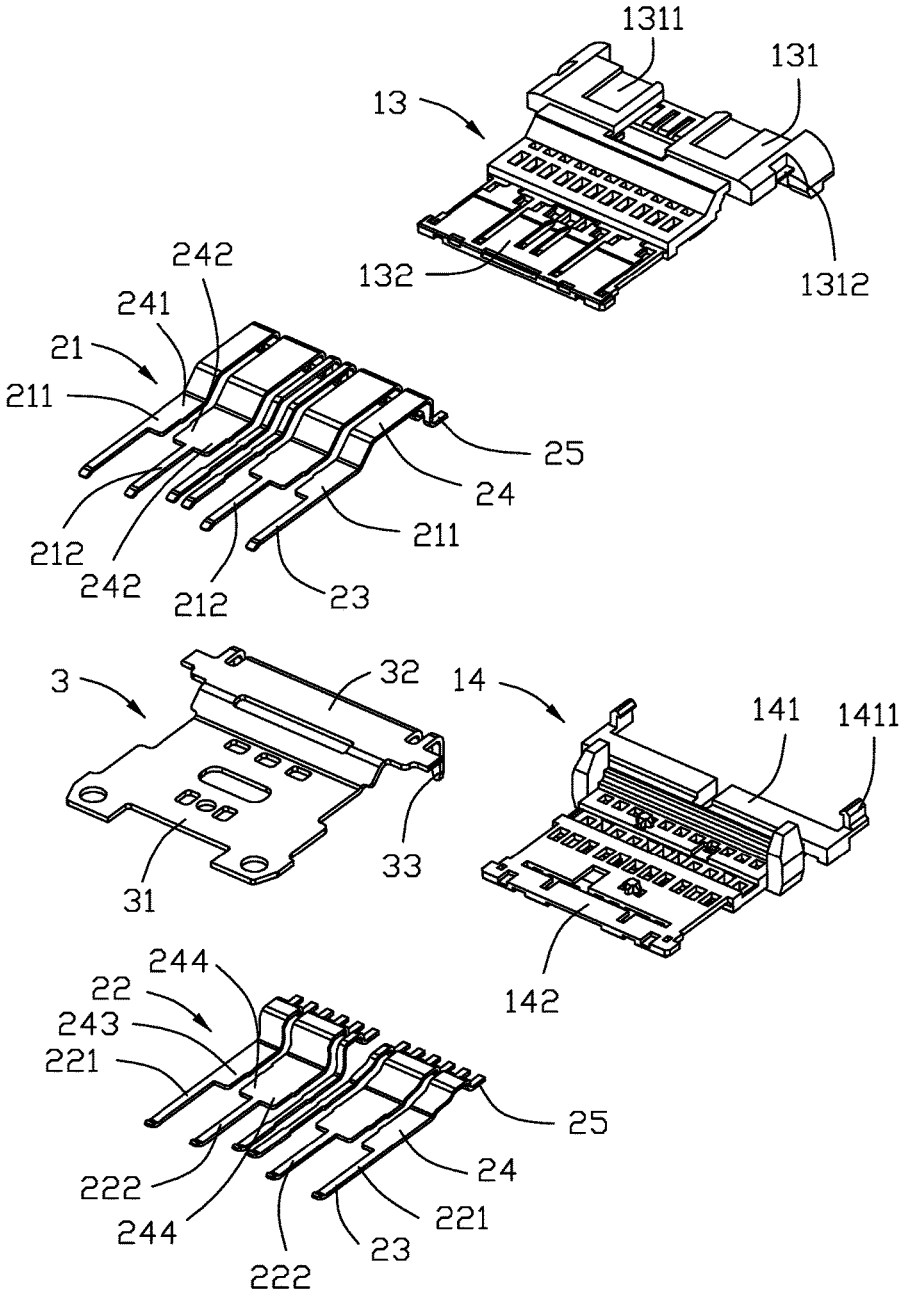
FIG. 7 is a further exploded view of the contact module in FIG. 5 omitting an over-mold thereof.
Figure 8:
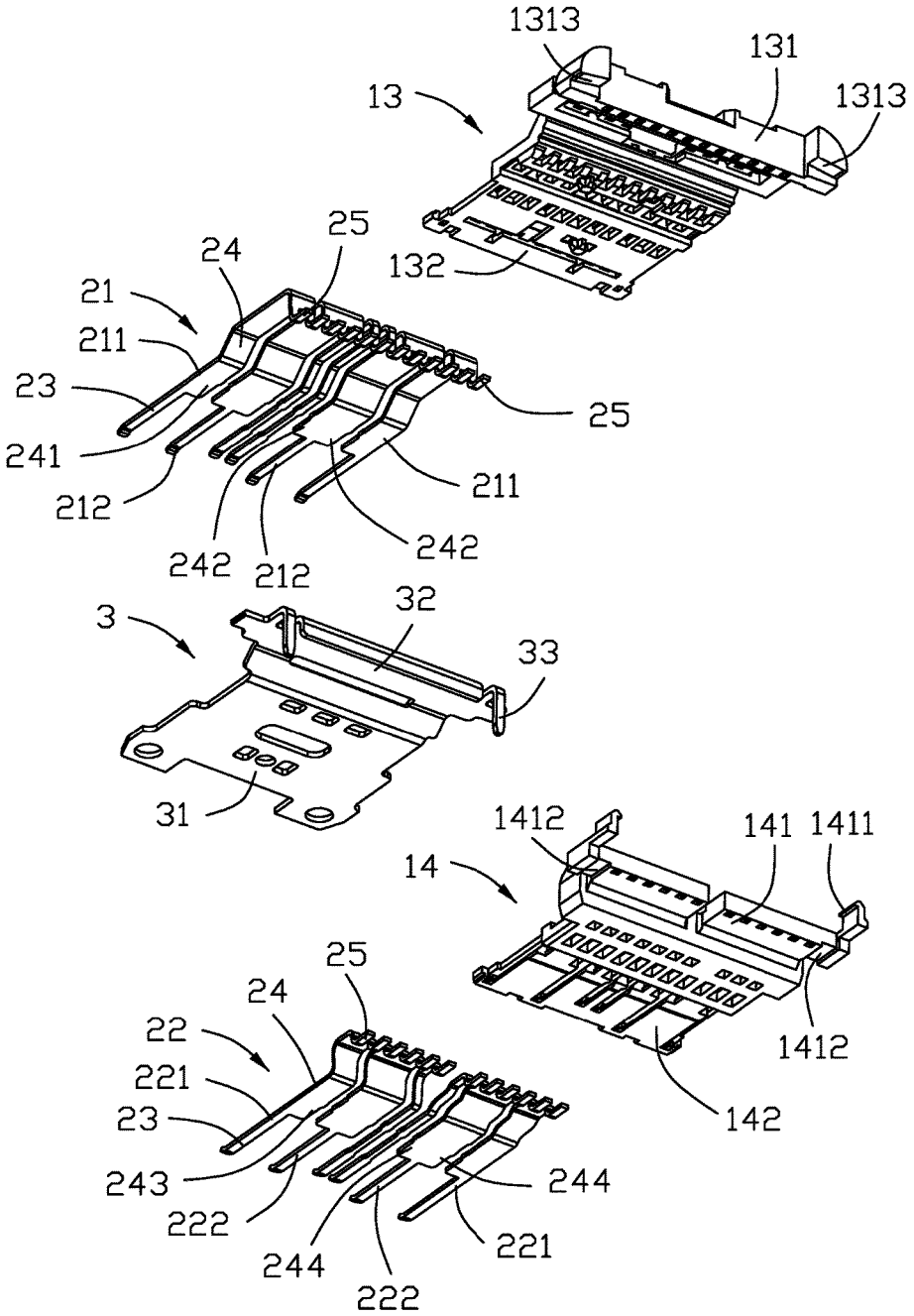
FIG. 8 is a rear view of the contact module in FIG. 7.

Referring specifically to FIGS. 7-9, as is well known in this art, the upper row of contacts 21 and the lower row of contacts 22 are reversely-symmetrically arranged and each contact 2 has a contacting portion 23, a tail portion 25, and an intermediate portion 24 between the contacting portion and the tail portion.

As shown in FIG. 9, the upper row of contacts 21 include a pair of ground contacts 211 at positions A1 and A12, a pair of power contacts 212 at positions A4 and A9, and a pair of signal contacts at positions A6 and A7. Positions A2-A3, A5, A8, and A10-A11 are vacant. Similarly, the lower row of contacts 22 include a pair of ground contacts 221 at positions B1 and B12, a pair of power contacts 222 at positions B4 and B9, and a pair of signal contacts at positions B6 and B7. Positions B2-B3, B5, B8, and B10-B11 are vacant.

In the upper row of contacts 21, for the pair of ground contacts 211 at positions A1 and A12, corresponding intermediate portion 24 has a respective widened section 241 to also occupy neighboring position A2 or A11. Moreover, each ground contact 211 has two tail portions 25. For the pair of power contacts 212 at positions A4 and A9, corresponding intermediate portion of the power contact at position A4 has two widened sections 242 to also occupy neighboring positions A3 and A5 and corresponding intermediate portion of the power contact at position A9 has two widened sections 242 to also occupy neighboring positions A8 and A10. Moreover, each power contact 212 has three tail portions 25. The additional tail portions all extend from the widened sections.

The ground and power contacts in the lower row of contacts 22 are similarly designed to have widened sections 243 and 244. Moreover, the plural tail portions 25 of the ground contacts 211 and the power contacts 212 in the upper row are arranged in one line and the plural tail portions 25 of the ground contacts 211 and the power contacts 212 in the lower row are arranged in another line.

The contacting portion 23 of each contact is not widened so that a width of the contacting portion 23 of the ground contact 211 or the power contact 212 is equal to a width of the contacting portion 23 of the signal contact. Without widening the contacting portion avoids potential short circuiting of the widened power contacts. Besides current flow and heat dissipation, the plural tail portions also strengthen soldering to a printed circuit board to which the electrical connector 100 is mounted.

The shielding plate 3 has a main part 31, a supporting part 32, and a pair of soldering legs 33.

Figure 3:
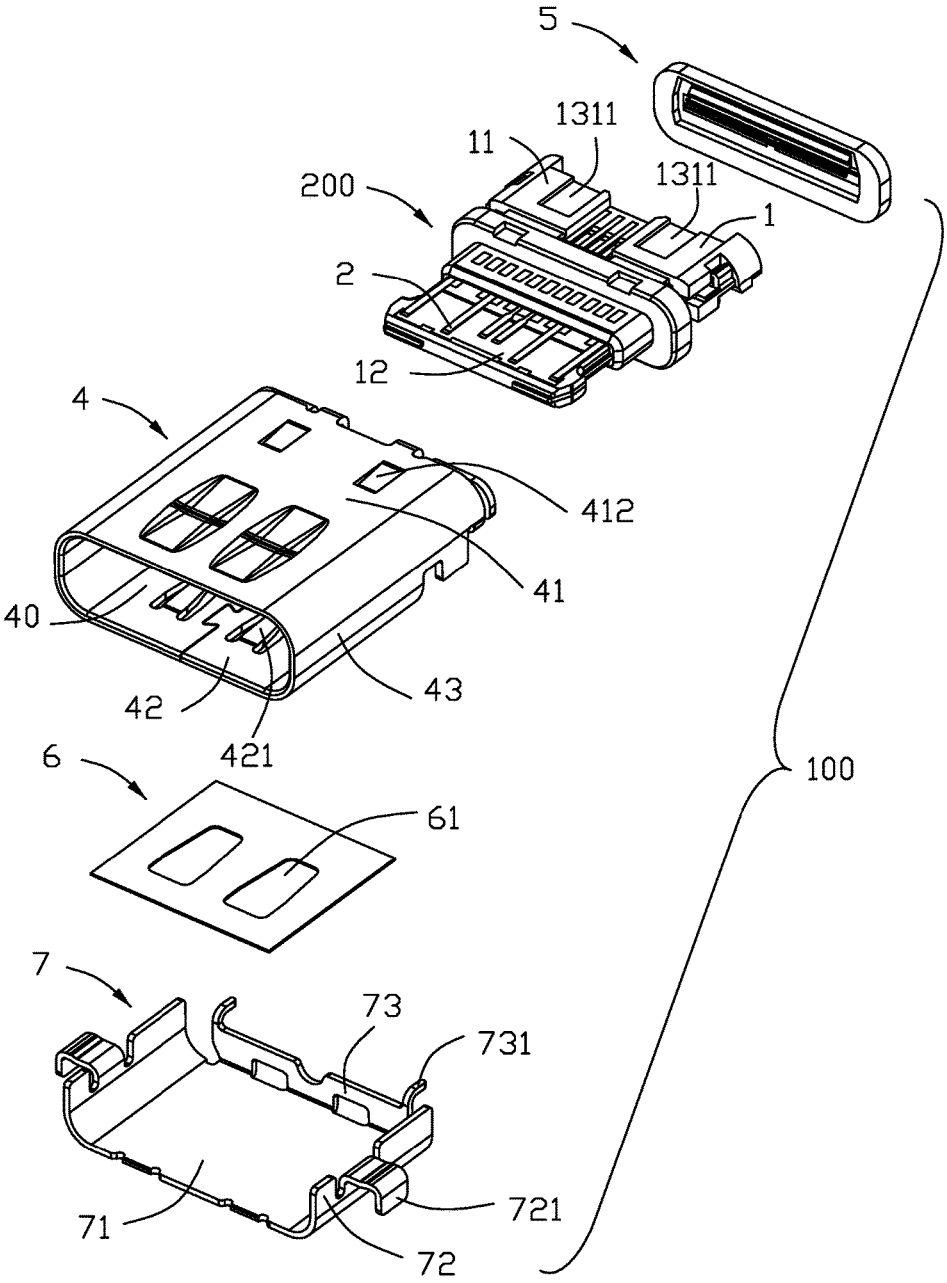
FIG. 3 is an exploded view of the electrical connector.
Figure 4:
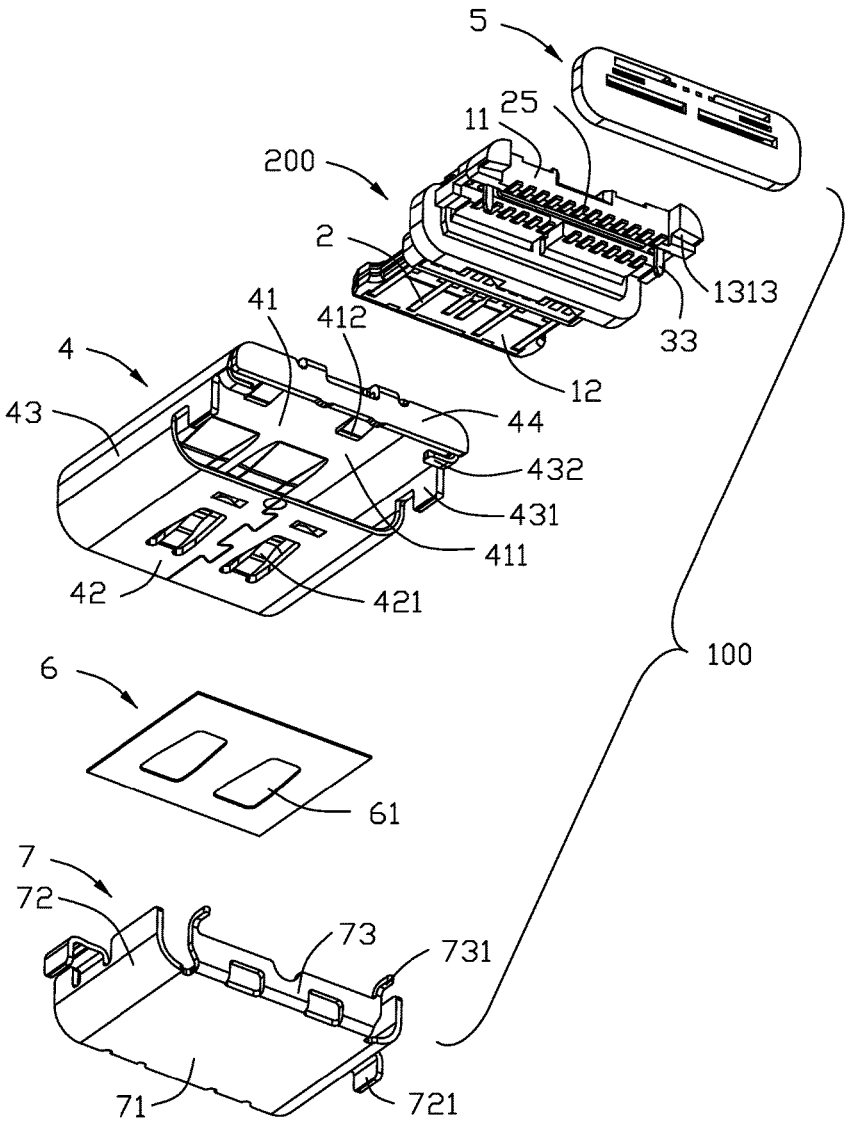
FIG. 4 is another exploded view of the electrical connector.
Figure 5:
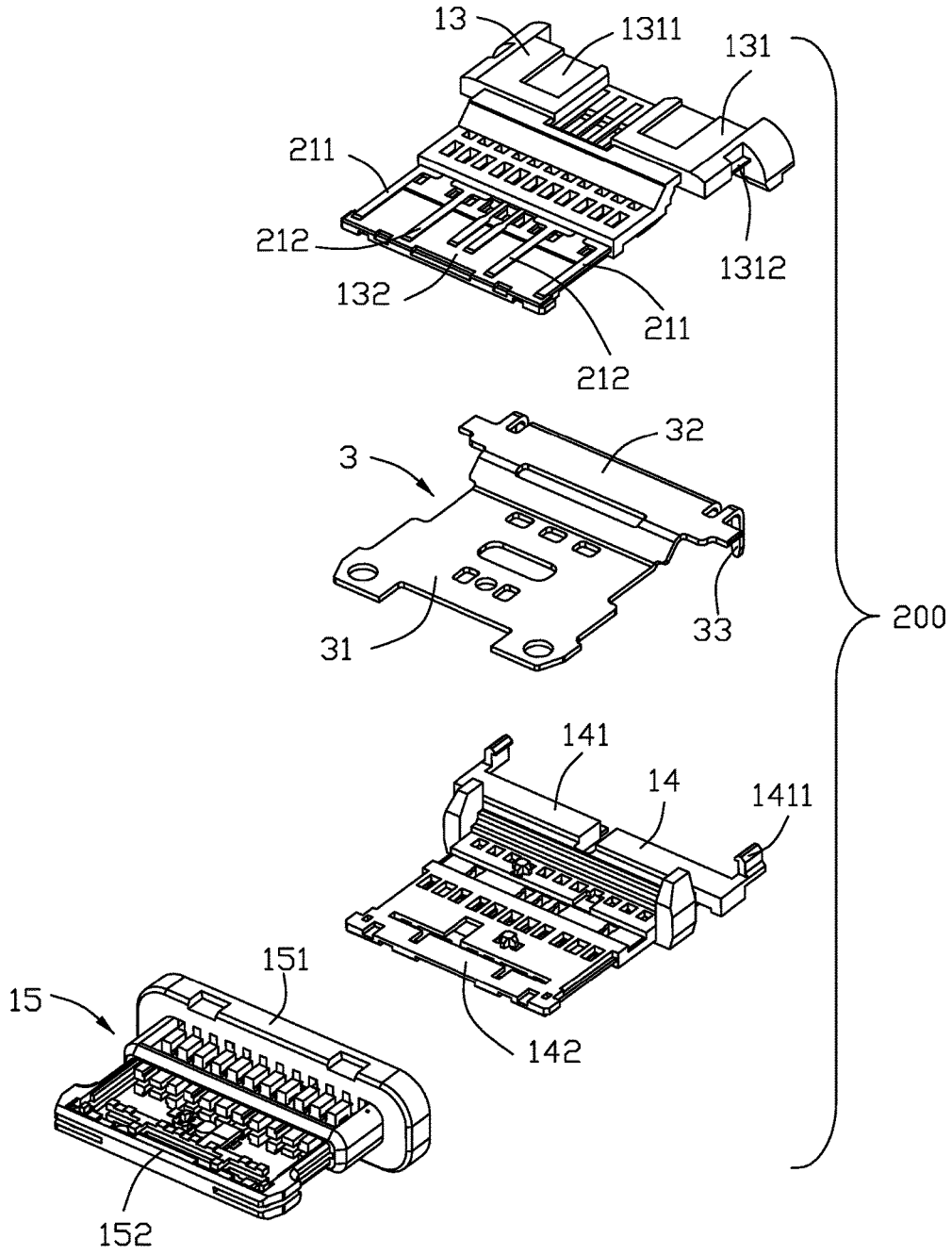
FIG. 5 is a front exploded view of a contact module of the electrical connector.
Figure 6:
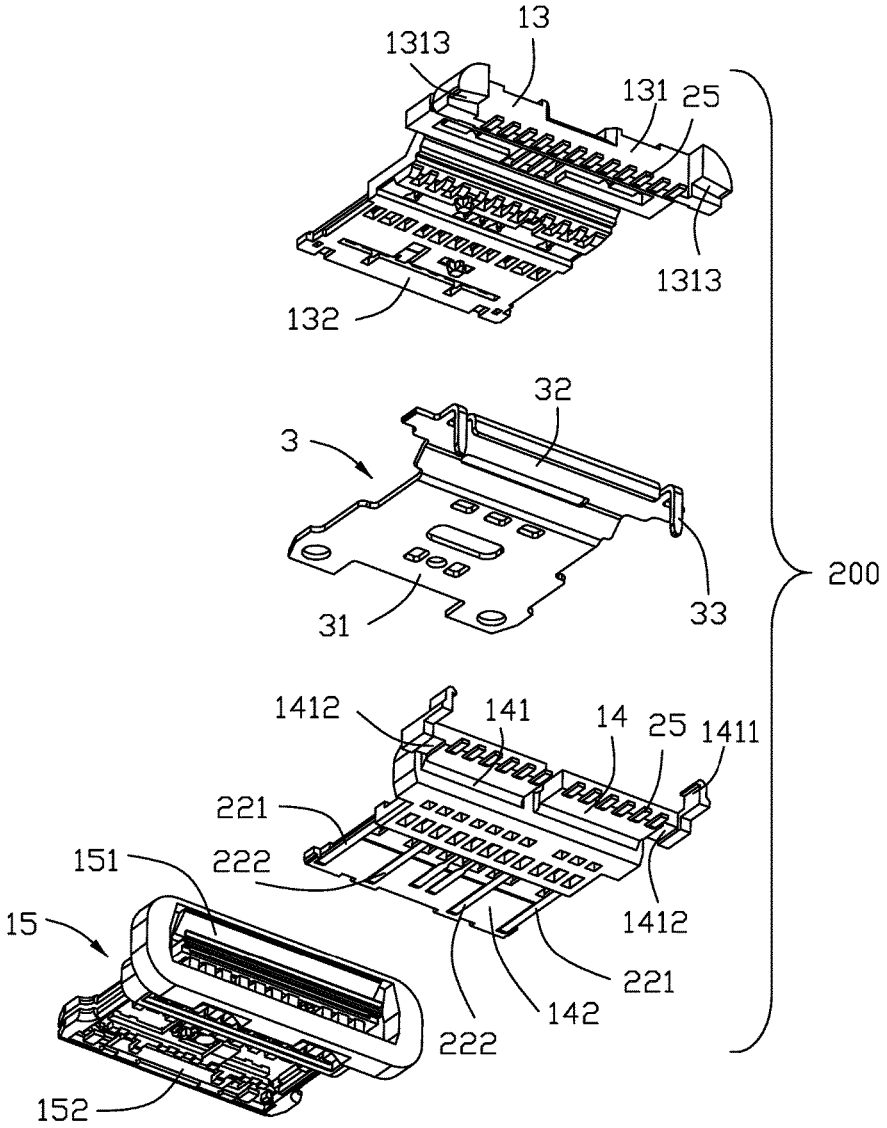
FIG. 6 is a rear exploded view of the contact module.

Referring to FIGS. 3-4, the shielding shell 4 has a top wall 41, a bottom wall 42, and a pair of side walls 43 surrounding a receiving space 40. The top wall 41 has a rear extension 44. The shielding shell 4 includes an opening 411. The top wall further has a pair of fixing tabs 412. The side walls 43 has a pair of positioning legs 431 and a pair of engaging tabs 432. The bottom wall 42 has a pair of spring tangs 421.

The water-proof film 6 has a pair of holes 61.

The auxiliary shell 7 has a main part 71, a pair of side walls 72, and a rear wall 73. Each side wall 72 has a leg 721. The rear wall 73 has a pair of clamps 731.

The electrical connector 100 is generally manufactured in processing steps well known in this art.

From a technical viewpoint, the subject connector 100 owns the configuration essentially compatible with the contour of the Type C connector including the contact tails in a full amount, i.e., the twelve tail portions in each row, while removing the contacting portions of the unused contacts, and further unifying the corresponding intermediate portions of those unused contacts with those of the operating/useful contacts for not only enhancing the structures thereof but also delivering much power or increasing grounding effect. As mentioned before, there are twelve positions for the contacts in each row. Notably, the arrangement of the invention is essentially in a symmetrical manner with regard to a front-to-back centerline of the tongue in the transverse direction thereof wherein the intermediate portion of the outermost ground contact owns essentially two positions, the intermediate portion of the innermost signal contact owns essentially only one position, while the intermediate portion of the middle power contact owns essentially three positions. Understandably, the whole space on the tongue is fully used in a symmetrical and systematical way based upon the standard full pin Type C connector, compared with the traditional large power delivery connector having the enlarged/widened intermediate portion thereof in an odd manner. It is also noted that in the embodiment the intermediate portion of the middle power contact has barbs on two sides while that of the outermost ground contact has barbs only on the inner side. It is also noted that the contact portion is symmetrical with regard to the intermediate portion along the transverse direction in the corresponding power contact and the signal contact while is asymmetrical with regard to that in the corresponding ground contact.

What is claimed is:

1. An electrical connector comprising:

an insulative housing having a base and a tongue;

two rows of contacts arranged in the insulative housing and exposed respectively to two opposite surfaces of the tongue, each row of contacts including an outermost ground contact and an adjacent power contact next to the ground contact; and a shielding shell enclosing the insulative housing, wherein each of the ground contact and the power contact in at least one of the two rows has a contacting portion, plural tail portions, and an intermediate portion between the contacting portion and the plural tail portions; wherein the ground contact has two tail portions and the power contact has three tail portions; wherein each row of contacts comprise a pair of outermost ground contacts and a pair of adjacent power contacts next to the pair of ground contacts, and the ground contacts and the power contacts in one row each have plural tail portions arranged in one line and the ground contacts and the power contacts in the other row each have plural tail portions arranged in another line.

2. The electrical connector as claimed in claim 1, wherein a width of the intermediate portion of each ground contact is greater than a width of the contacting portion thereof, and a width of the intermediate portion of each power contact is greater than a width of the contacting portion thereof.

3. The electrical connector as claimed in claim 1, wherein a width of the tail portion of each ground contact is equal to a width of the contacting portion thereof, and a width of the tail portion of each power contact is equal to a width of the contacting portion thereof.

4. An electrical connector comprising:

an insulative housing having a base and a tongue defining twelve positions in a transverse direction;

two rows of contacts arranged in the insulative housing and exposed respectively to two opposite surfaces of the tongue in a vertical direction position to said transverse direction, in each row said contacts arranged in a symmetrical manner with regard to a front-to-back extending centerline of the tongue portion in said transverse direction and including a pair of outermost ground contacts, a pair of innermost signal contacts and a pair of power contacts therebetween; and each of said contacts having a front contact portion, a rear tail portion and an intermediate portion therebetween in a front-to-back direction perpendicular to said transverse direction and said vertical direction; wherein the intermediate portion of the outermost ground contact occupies two positions, the intermediate portion of the innermost signal contact occupies one position while the intermediate portion of the power contact occupies three positions; wherein there are twelve tail portions in each row corresponding to said twelve positions; wherein the contact portion is essentially symmetrical with regard to the corresponding intermediate portion in both the power contact and the signal contact in the transverse direction while is symmetrical in the ground contact.

5. The electrical connector as claimed in claim 4, wherein barbs are formed on two sides of the intermediate portion of the power contact while on only an inner side of the intermediate portion of the outermost ground contact.

* * * * *